US005241716A

United States Patent [19]

Kohus

[11] Patent Number: 5,241,716

[45] Date of Patent: Sep. 7, 1993

[54] FOLDABLE PLAY YARD HAVING MESHING HINGE GEAR FRAME LOCKS

[75] Inventor: Louis M. Kohus, Cincinnati, Ohio

[73] Assignee: Baby Trend, Inc., Pomona, Calif.

[21] Appl. No.: 957,692

[22] Filed: Oct. 7, 1992

[51] Int. Cl.[5] ..... A47D 13/06

[52] U.S. Cl. ..... 5/99.1; 5/98.1; 16/354

[58] Field of Search ..... 5/99.1, 98.1, 93.1; 16/354, 366, 349

[56] References Cited

U.S. PATENT DOCUMENTS

| | | | |
|---|---|---|---|
| 2,698,443 | 1/1955 | Ralick | 5/99.1 |
| 4,070,716 | 1/1978 | Satt | 5/99.1 |
| 4,376,318 | 3/1983 | Cirillo | 5/99.1 |
| 4,483,026 | 11/1984 | Kassai | 5/99.1 |
| 4,614,454 | 9/1986 | Kassai | 16/354 |
| 4,811,437 | 3/1989 | Dillner et al. | 5/99.1 |
| 4,837,875 | 6/1989 | Shamie | 5/99.1 |
| 4,934,025 | 6/1990 | Mariol | 16/347 |
| 4,985,948 | 1/1991 | Mariol | 5/99.1 |

FOREIGN PATENT DOCUMENTS 2365918 3/1977 Fed. Rep. of Germany ..... 16/354

*Primary Examiner*—Peter M. Cuomo
*Assistant Examiner*—Flemming Saether
*Attorney, Agent, or Firm*—Charles R. Wilson

[57] ABSTRACT

A portable play yard comprises a frame assembly and a fabric enclosure. The frame assembly comprises lower and upper corner rail connecting members, vertical corner rails, a pair of pivotally connected floor support rails between each set of lower corner rail connecting members, and a pair of pivotally connected upper side rail members between each set of upper corner rail connecting members. A frame lock is mounted on ends of the upper side rails to hold the side rails in a straight in-line mode or, upon rotation, allows the side rails to pivot downwardly. Meshing hinge gears in each frame lock form a single pivot point for the two upper side rail ends held by the frame lock. The frame assembly is folded to a compact unit by initially rotating the frame locks and then folding the assembly. The frame assembly is capable of holding the fabric enclosure so as to provide a play yard.

10 Claims, 6 Drawing Sheets

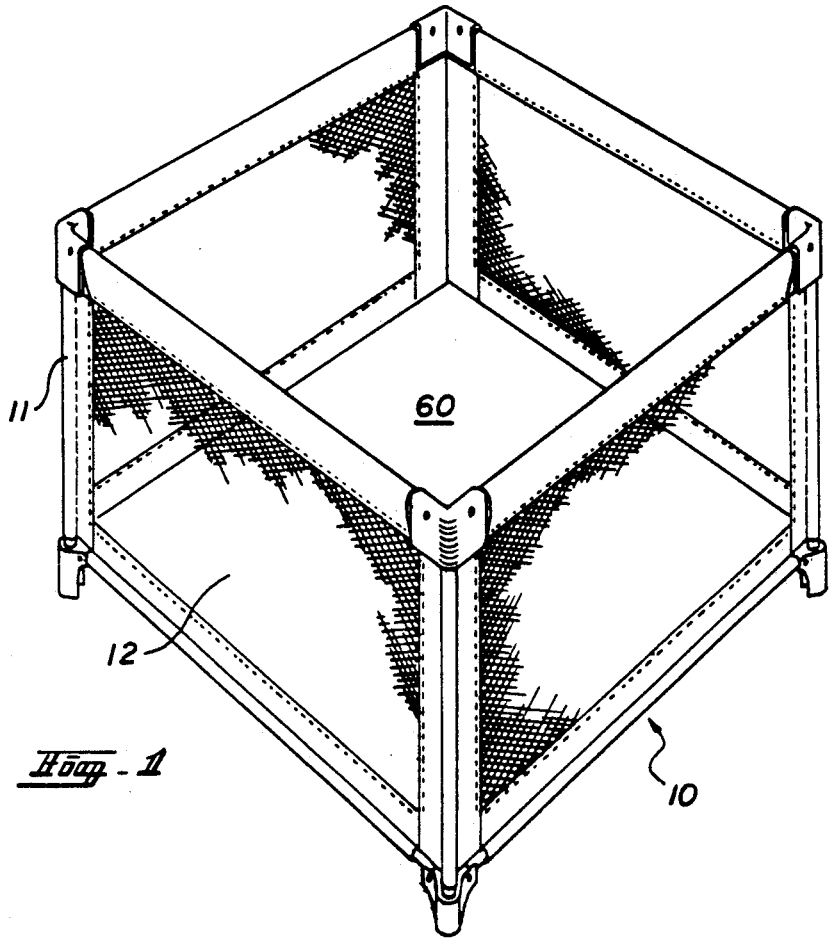
Fig. 1
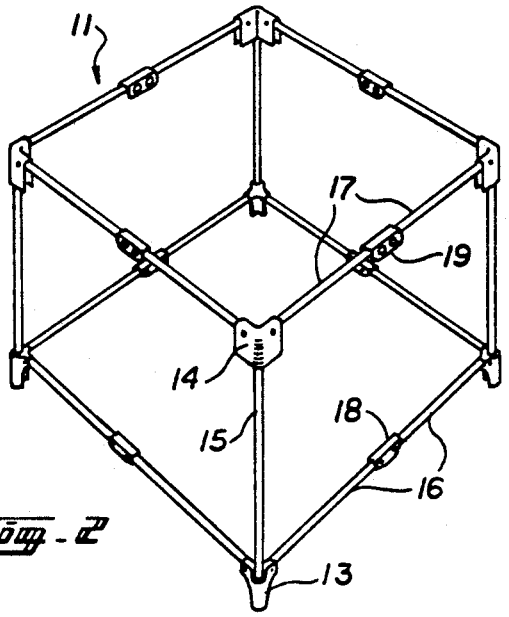
Fig. 2
Fig. 3
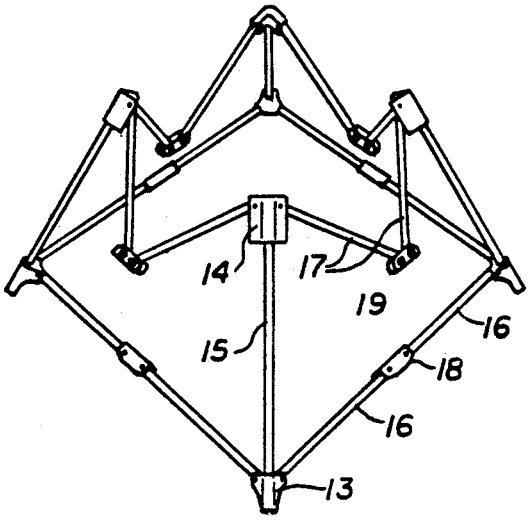

Fig. 15
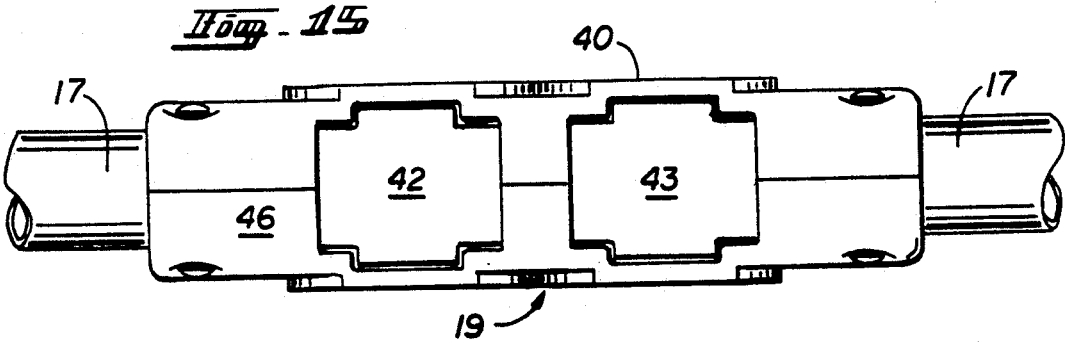
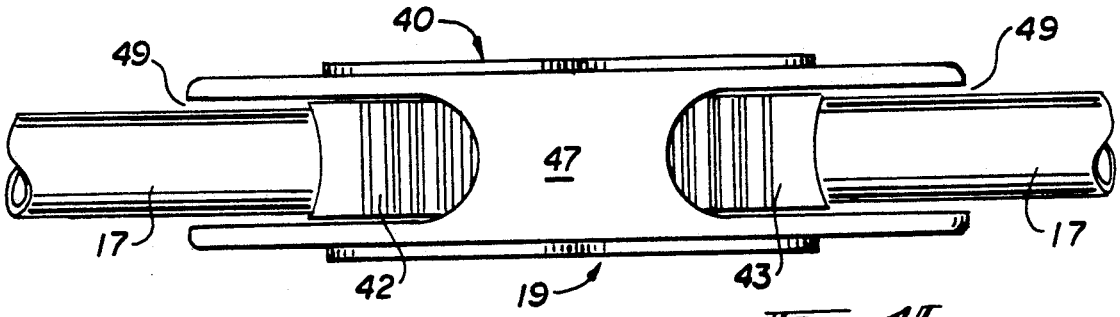
Fig. 16
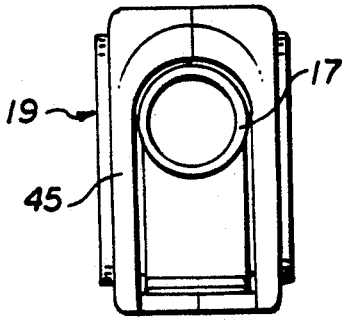
Fig. 17
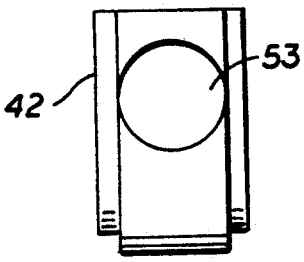
Fig. 19
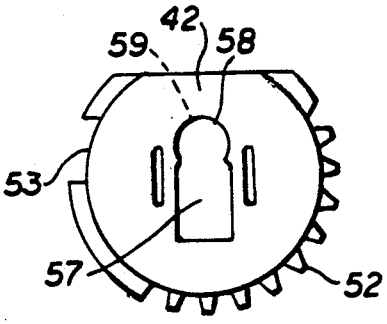
Fig. 18
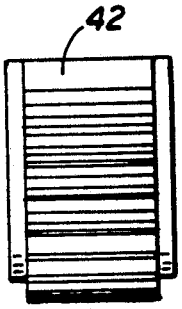
Fig. 20

Fig. 21
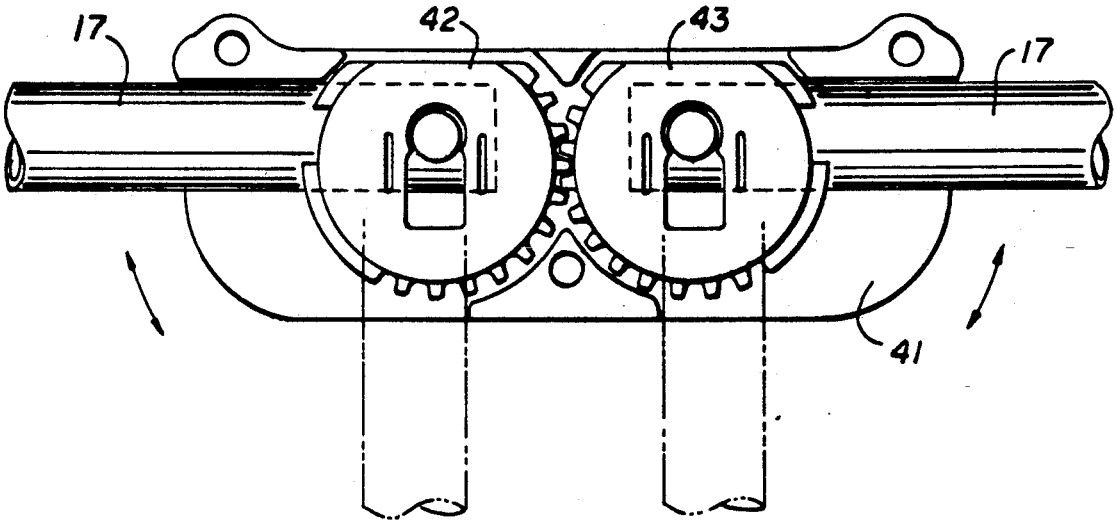
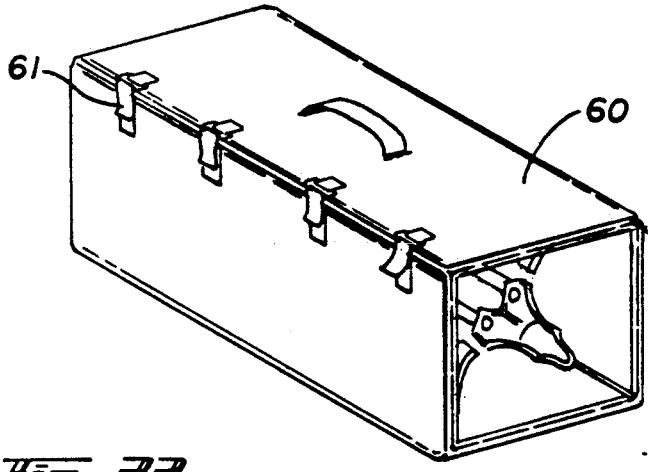
Fig. 22

FOLDABLE PLAY YARD HAVING MESHING HINGE GEAR FRAME LOCKS

This invention relates to a play yard. More particularly, the invention relates to a play yard which is foldable into a compact unit ready for convenient transporting and storing.

BACKGROUND OF THE INVENTION

Many structures variously referred to as playpens and, more recently, play yards have been designed. Most of the early playpens which have been commercialized were rather bulky and very cumbersome to use. Various examples of such playpens can be found in U.S. Pat. Nos. 2,464,866, 2,491,036, 2,590,315, 2,784,420, 3,165,760 and 4,538,309. Many of these playpens are referred to as being foldable and, therefore, portable. Those which are folded to a size which is still generally large and difficult to transport are not truly portable. Other playpens which are said to be portable are in fact of the type which must be disassembled and later reassembled. It is readily apparent that labeling a playpen as portable does not make it so. Playpens which because of their bulky size or because of the time consuming steps needed for disassembly and reassembly are not portable in the commonly accepted use of the term.

Even more recently, structures for juvenile use designed and disclosed in U.S. Pat. Nos. 4,811,473 and 4,934,025 have been commercialized. The structures are referred to as play yards. The foldable play yard described in U.S. Pat. No. 4,811,437 requires a central hub and pivotally attached floor support legs emanating therefrom and pivotally attached to lower corner members. The play yard also requires upper side rails which are pivotally attached together at a mid-point by latch means and pivotally attached to upper corner members. The manner in which the side rails are attached together at the mid-point appears crucial to having a structure which is foldable, yet is sturdy when in-use. The disclosed latch means comprises several discrete parts which must be separately manufactured to strict tolerances and then assembled in multi-steps. The play yard described in U.S. Pat. No. 4,934,025 is also foldable. It is similar to the play yard of U.S. Pat. No. 4,811,437 in requiring a central hub, pivotally attached floor support legs, and upper side rails which are pivotally attached together in a mid-point and to upper shoulder brackets. A unique hinge is used to connect the upper side rails in the midpoint. The hinge rotates from a locked to an unlocked position. However, here also the hinge must be precisely manufactured and assembled in many steps. Each requirement adds to the cost of the product.

There is still a need for a play yard which is truly portable. Such a play yard necessarily must be folded into a size which is compact. Ideally, the play yard would be comprised of a minimum number of parts so as to allow for an easy sequence of folding steps as well as to reduce the cost of any such structure. In accordance with this need, there has been developed a portable play yard which is foldable to a compact size. The play yard is economical to manufacture and is easy to use.

SUMMARY OF THE INVENTION

A portable play yard comprises a frame assembly and a fabric enclosure adapted to fit onto the frame assembly. The frame assembly is comprised of lower corner rail connecting members, upper corner rail connecting members, vertical corner rails permanently attached to the lower and upper corner rail connecting members, a pair of pivotally connected together floor support rails extending between and pivotally connected to each set of lower corner rail connecting members, and a pair of pivotally connected together upper side rail members extending between and pivotally connected to each set of upper corner rail connecting members. The pairs of upper side rail members are pivotally connected together by means of frame locks which have a pair of hinge gears operably associated to act as a single pivot point for the upper side rail members. The frame locks are capable of locking the side rails in a straight line in-use configuration or, when rotated, are capable of allowing the side rails to fold downwardly. The play yard is broken down by rotating the frame locks to cause the upper side rails to pivot downwardly to become substantially parallel with the vertical corner rails. The floor support rails also are capable of pivoting upwardly to become substantially parallel with the vertical corner rails. In effect, the play yard is folded to a compact unit by breaking down the frame assembly so that all the rails become substantially parallel with one another and lie adjacent a center line axis.

BRIEF DESCRIPTION OF THE DRAWINGS

FIG. 1 is a view in perspective of a portable play yard when assembled in accordance with the present invention.

FIG. 2 is a view in perspective of the frame assembly of the play yard of FIG. 1.

FIG. 3 is a view in perspective of the frame assembly of FIG. 2 with each set of upper side rails folded down to a position which is intermediate in the sequence of folding positions.

FIG. 15 is a top view of the frame lock of FIG. 14.

FIG. 16 is a bottom view of the frame lock of FIG. 14.

FIG. 17 is an end view of the frame lock of FIG. 14.

FIG. 18 is a side view of a hinge gear used in the frame lock of FIG. 14.

FIG. 19 is an end view of the hinge gear of FIG. 18.

FIG. 20 is another end view of the hinge gear of FIG. 18.

FIG. 21 is a side view of the frame lock of FIG. 14 as used on the frame assembly of FIG. 2 with a housing half removed.

FIG. 22 is a view in perspective of the play yard of the invention fully folded and packed for transporting or storing.

DETAILED DESCRIPTION OF THE INVENTION

Figure 4:
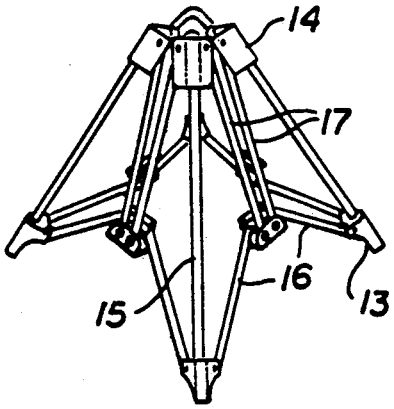
FIG. 4 is a view in perspective of the frame assembly of FIG. 2 with each set of floor support rails folded to a position next prior to a fully folded frame assembly.

The portable play yard of this invention comprises a frame assembly and a fabric enclosure. The following paragraphs describe in detail the components of the play yard and its manner of use.

With reference to FIG. 1 there is illustrated a play yard 10 of the invention wherein a frame assembly 11 is in the in-use position with a fabric enclosure 12 properly positioned on the assembly. The frame assembly 11 as best seen in FIG. 2 comprises as its essential components lower corner rail connecting members 13, upper corner rail connecting members 14, vertical corner rails 15, pivotally connected floor support rails 16 and pivotally connected upper side rails 17. An intermediate pivot connecting member 18 pivotally holds ends of the floor support rails in a manner which allows the rails to pivot upwardly only. An intermediate frame lock 19 pivotally holds ends of the upper side rails. The frame lock when properly oriented by manual rotation allows the side rails to pivot downwardly. These individual components are further described in paragraphs following a general description of how the frame assembly functions.

Figure 5:
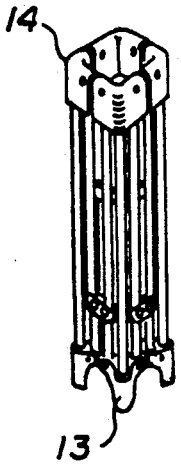
FIG. 5 is a view in perspective of the frame assembly of FIG. 2 when in a fully folded state.

FIGS. 2-5 show the frame assembly in a series of positions ranging from the fully opened in-use mode of FIG. 2 to the fully folded non-use mode of FIG. 5. The first step of folding the frame assembly is shown in FIG. 3 wherein the frame locks 19 are properly oriented and each pair of upper side rails 17 is folded downwardly towards the center of the frame assembly. Next, as shown in FIG. 4, each pair of floor support rails 16 is folded upwardly. Finally, as shown in FIG. 5, the upper side rails 17 and floor support rails 16 are gathered together by forcing each pair of rails to fully pivot about its respective center pivot point so as to be substantially parallel with the vertical corner rails 15. It is the unlocking of the frame locks 19 which permits the side rails and floor support rails to pivot towards one another and cause the lower and upper corner rail connecting members to swing towards one another. In effect, the four lower corner rail connecting members 13 now provide a base for the fully folded frame assembly thereby allowing it to sit in an upright convenient position shown in FIG. 5.

Figure 6:
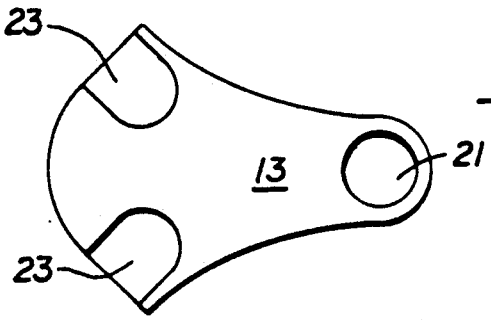
FIG. 6 is a top view of a lower corner rail connecting member used on the frame assembly of FIG. 2.
Figure 7:
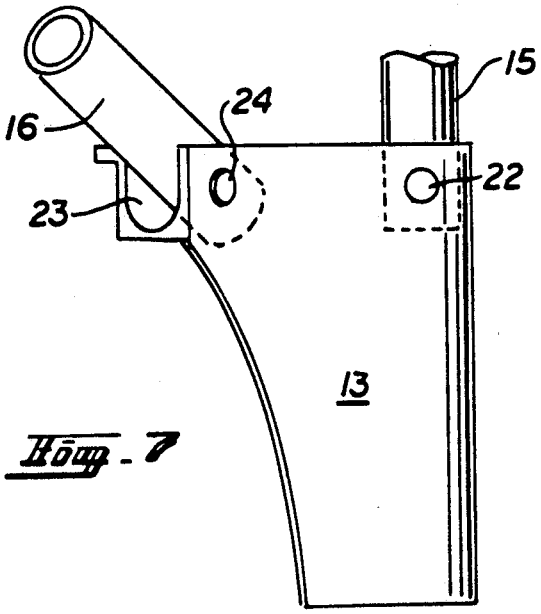
FIG. 7 is a side view of the lower corner rail connecting member of FIG. 6.
Figure 8:
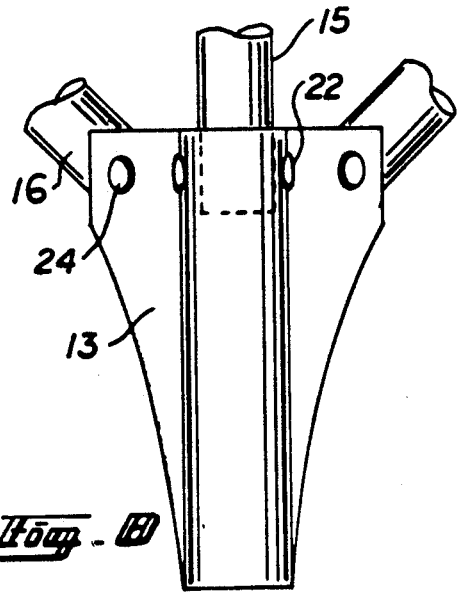
FIG. 8 is an end view of the lower corner rail connecting member of FIG. 6.

As should be apparent from FIGS. 1 and 2, the frame assembly 11 assumes a box-like outline when in an in-use mode. Each of the four lower corner rail connecting members 13 serves as a foot for the frame assembly in immovably holding a vertical support rail 15 and pivotally holding two floor support rails 16 With reference to FIGS. 6-8, the lower corner connecting member 13 has a generally Y-shaped body. Its height is sufficient to ensure that the floor support rails, and hence floor of the play yard, are raised off ground level. The Y-shaped body has a cavity 21 at its base leg to receive a vertical corner rail 15 in a fixed position. Means are provided to permanently secure it, e.g. rivets 22. The branching legs of the Y-shaped body have an open top channel 23 to receive two floor support rails at substantially right angles to one another. The tops of the channels are preferably contoured to receive and pivotally hold the support rails. The open area in the Y-shaped body below the two channels is needed to permit a rail end to swing into it as the rail pivots about its pivot point. A rivet pin 24 is conveniently used to hold the floor support rails in place.

The lower corner rail connecting members 13 are constructed so that they form the lower four corners of the play yard and that the floor support rails 16 extend therefrom so as to form a square shape. The body of the corner rail connecting members can be other shapes. However, the Y-shape body is preferred in that it allows the floor support rails to nest in a compact manner alongside the vertical support rails when the play yard is collapsed and folded together.

Figure 9:
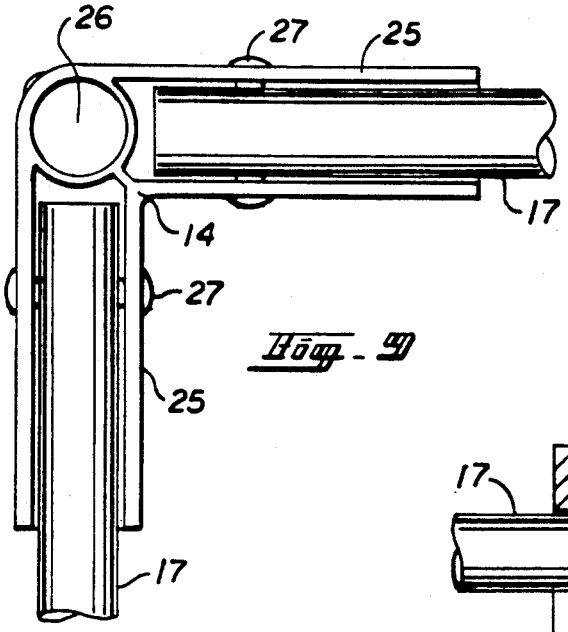
FIG. 9 is a bottom view of an upper corner rail connecting member used on the frame assembly of FIG. 2.
Figure 10:
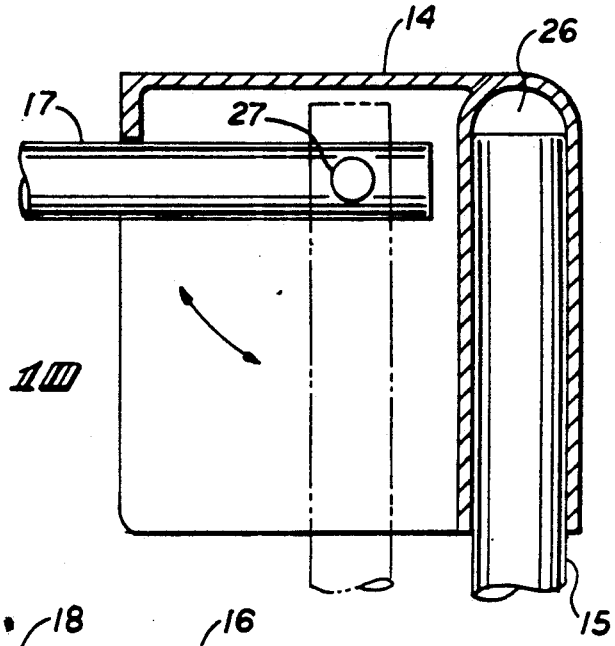
FIG. 10 is a side view in section of the upper corner rail connecting member of FIG. 9.

The upper corner rail connecting members 14 are constructed to permanently and immovably hold the vertical support rails 15 and to pivotally hold two upper side rails 17. As best seen in FIG. 9, the upper corner rail connecting member 14 is a right angle hollow body. The intersection of the two legs 25 of the body has a cavity 26 dimensioned to receive an upper end of the vertical corner rail. Mechanical means are provided to permanently hold it, e.g. a rivet, bolt and nut or other conventional attachment means. Each leg 25 of the corner rail connecting member is hollowed to receive an end of an upper side rail 17 and pivotally hold it. The open portion of the hollowed body allows the upper side rail to pivot downwardly into the body. A pivot pin 27 extends through the side walls of the legs of the hollow body and side rail end, though other means of pivot attachment can be used.

A pair of the floor support rails 16 extends between each adjacent set of lower corner rail connecting members 13. The two pairs of support rails 16 which are parallel to one another are the same approximate length. End and side floor support rail pairs can be a different length depending on whether a square-shaped or rectangular-shaped play yard is desired. As aforementioned, one end of each floor support rail is pivotally attached to a lower corner rail connecting member 13. The other end of each is pivotally connected together by an intermediate hinged connecting member 18.

Figure 11:
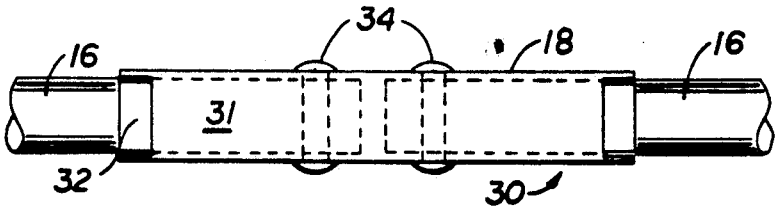
FIG. 11 is a top view of an intermediate pivot connecting member used to pivotally connect the floor support rails of the frame assembly of FIG. 2.
Figure 12:
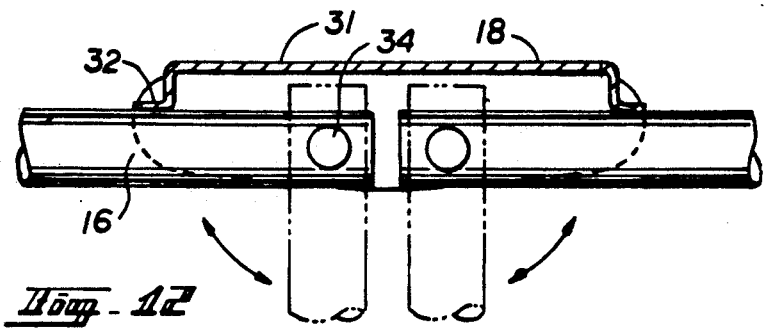
FIG. 12 is a side view in section of the pivot connecting member of FIG. 11.
Figure 13:
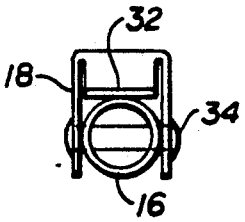
FIG. 13 is an end view of the pivot connecting member of FIG. 11.

The intermediate pivot connecting member 18 allows the floor support rails to pivot in one direction only. With reference to FIGS. 11-13, it comprises a housing 30 having a substantially solid top wall 31 with end shoulders 32 to hold, but restrict downward movement of the floor support rails to a horizontal position, an open end side to receive the support rails and an open bottom side which permits the support rails to swing upwardly. Pivot pins 34 pivotally hold the support rails 16 to the pivot connecting member 18.

A pair of pivotally connected upper side rails 17 extends between adjacent upper corner rail connecting members 14. The lengths of each of these rails is approximately the same as an underlying floor support rail. Each upper side rail 17 is pivotally connected on one end to the upper corner rail connecting member 14 and pivotally connected at the other end to the intermediate frame lock 19. The frame lock 19 is capable of locking each pair of side rails in a straight line in-use configuration. Upon manual rotation of the frame lock about its axis, the side rails are released to cause them to pivot downwardly. As discussed below in detail, the frame locks have operably associated hinge gears which cause each frame lock to act as a single pivot point for the upper side rail pairs. This allows the play yard to be erected or folded to a compact state in an orderly fashion.

With reference to FIGS. 14–21, the frame lock 19 comprises a housing 40 of mating halves 41 which is able to hold two meshing hinge gears 42 and 43. The housing 40 has two side walls 44, two end walls 45, a top wall 46 and a bottom wall 47. Each side wall 44 has a recessed area 48 to accommodate the two hinge gears 42 and 43 to hold them in place. Thus, the recessed area is slightly larger than the hinged meshing gears. Each of the two end walls 45 has an arcuate slot 49 to receive an end of a side rail 17 and permit its movement in an approximate 90 degree arc. The underside 50 of the top wall 46 at each arcuate slot 49 area restricts movement of the upper side rails beyond a substantially horizontal in-use plane. The bottom wall 47 has a projection 51 to restrict movement of the side rails beyond a substantially vertical non-use plane.

The meshing hinge gears 42 and 43 are dimensioned to nest in the recessed areas 48 of the mating housing halves 41 and to revolve therein upon movement of the upper side rails. Each hinge gear has a set of teeth 52 extending about 90 degrees around its circumference. A top portion of each gear is truncated to present a smooth top surface to the frame lock, with a resultant low profile. Each hinge gear also has a bore hole 53 to receive an end of the side rail. The bore hole is about opposite a start of the 90 degree arcuate arrangement of gear teeth. The meshing gear teeth of the two hinge gears create a single pivot point for the upper side rails at their respective two ends. It ensures that each upper side rail pair operates as a unit; when one upper side rail is caused to move to an in-use position or to a non-use configuration, the other associated upper side rail of the pair moves in concert.

As evident in FIG. 18 the bore hole 53 is off-center such that a top of the side rail engages the underside 50 of the housing when the rails are in an in-use position. Placement of the bore hole off-center also results in a low profile for the top rail of the play yard.

Figure 14:
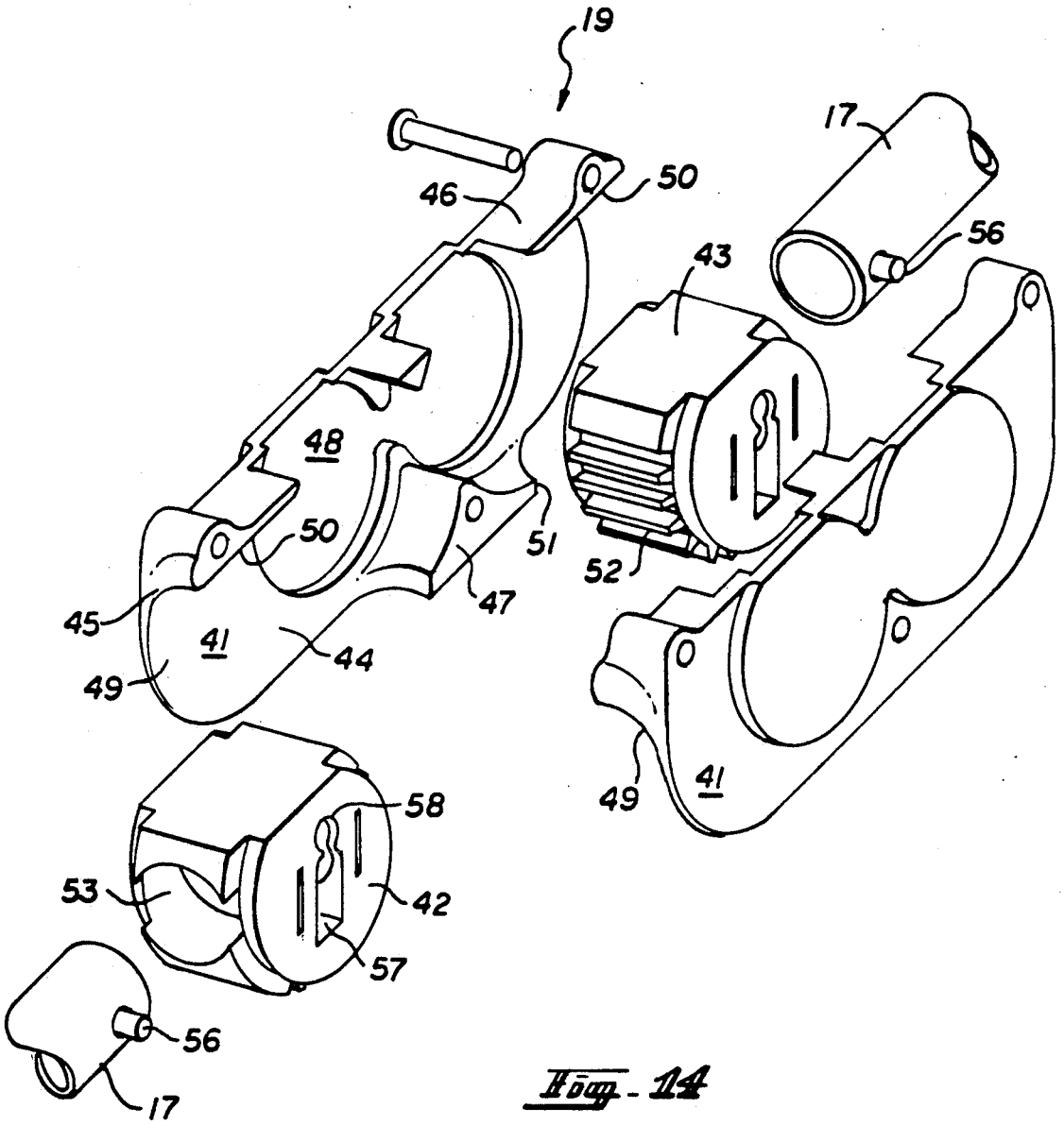
FIG. 14 is an exploded view in perspective of an intermediate frame lock used to pivotally connect the upper side rails of the frame assembly of FIG. 2.

A latch means is used to rotatably hold the side rail in the hinge gear. Several different mechanisms can be used for this purpose. As shown in FIG. 14, the latch means comprises a spring button 56 mounted near the terminus of the side rail end and a key hole opening 57 in the hinge gear which is in communication with the bore hole. The key hole opening 57 is dimensioned to receive the spring button and extends from both faces of the hinge gear to the bore hole. Rotation of the frame lock causes the hinge gears to rotate about the side rail end. The spring button 56 restricts the revolving movement of the hinge gears and hence frame lock and also keeps the hinge gears from pulling off their respective rails. As the hinge gear revolves about the upper side rail and its associated spring button, the key hole opening travels about the spring button. At the start of the revolving motion, the spring button protrudes through a rounded portion 58 of the opening on the front side of the key hole 57. In movement, the hinge gear revolves such that it travels approximately 180 degrees until the spring button protrudes through a rounded portion 59 of the opening on the back side of the key hole opening 57. The rounded portions of the openings snugly hold the spring button in the rest positions. In effect the hinge gears work in conjunction with the spring button to restrict the revolving movement to approximately 180 degrees.

Other latch means can be used to rotatably hold the side rails to the hinge gears. For example, conventional attaching means such as rivets, bolts and nuts are used.

Rotation of the frame lock 19 so that the open-side bottom wall 17 is on top allows the upper side rails 17 to pivot down both at the upper corner rail connecting members and at the frame lock. This then allows the floor support rails to pivot both up at the lower corner rail connecting members and the intermediate rail connecting member. It should be apparent that the frame lock 19 is comprised of a minimum number of parts, most of which can be molded to exact dimensions with little concern for subsequent manufacturing variances. The components of the frame lock are also readily assembled. In use, the frame locks ensure that the frame assembly of the play yard will not accidentally collapse. The degree of strength and mental awareness needed to rotate the frame lock to an unlocked position to break down the upper side rails is possessed by the normal adult, but not the normal child placed in the play yard.

The lower and upper corner rail connecting members, pivot connecting members and frame locks can be molded from a rigid polymeric plastic material. The vertical corner rails, floor support rails and upper side rails can be made of a rigid, lightweight metal material. Other materials of construction can be used as will be readily available to the manufacturer.

The flexible fabric enclosure 12 comprises side panel portions and a floor portion. These portions of the enclosure are stitched together to form a unitary flexible structure. If desired, side panel portions may be provided with netting as shown in FIG. 1 so as to enhance ventilation and to allow the child to see and be seen. Each of the side panel portions includes lower and upper laterally extending tubular sleeves. The side panel portions are joined together by vertically extending tubular sleeves. The sleeves facilitate mounting of the fabric enclosure 12 of the play yard frame onto the frame assembly 11. Preferably, the upper side rail enclosure sleeves are lined inside with foam cushion sleeves to ensure the child cannot injure himself or herself by the rigid upper side rails.

A removable floor 60 is preferably a part of the play yard. Preferably, the floor has four substantially equal rectangular-shaped sections which allow it to fold into a four sided box-like shape. The fully folded frame assembly and its overlying fabric enclosure can be placed on the flattened-out floor support and the floor support folded to its box shape as shown in FIG. 22. If desired, fabric material fasteners, such as hook and loop fasteners 61, or snap fasteners can be used to secure the folded floor in the box-shaped configuration. An optional carry bag (not shown) can be slipped over the folded floor and its contents to hold the whole unit together in a form very conducive to transporting by hand. Additionally, the compact unit can be stored in a minimum of space.

In operation, the play yard of the present invention is easily assembled, erected and folded. When erected, the play yard is maintained in a stable configuration with the vertical corner rails upstanding. The corner rails are spread by the floor support rails and upper side rails. The frame locks steady the upper side rails in a sturdy horizontal position which cannot be inadvertently unlocked by a child.

There is no need to disassemble any parts to collapse the play yard. In collapsing the play yard, all four frame locks are manually rotated approximately 180 degrees, i.e. a half-turn. This causes the upper side rails to pivot downwardly at the mid-point. The floor support rails are caused to fold upwardly merely by lifting the fabric floor of the play yard to cause the support rails to pivot at their mid-points. All four vertical corner rails are gathered together such that the resultant structure is a compact unit of vertical support rails, upper side rails and floor support rails nestled together in a parallel relationship.

The play yard is foldable to a compact configuration wherein it is easily transportable from one location to another. The discrete foldable floor provides a smooth, sturdy cushioned playing surface for the child while being foldable to a box-shape configuration for housing and transporting the collapsed play yard. While the invention has been described with specific reference to the drawings, other embodiments and modifications are apparent and intended to be within the scope of the claimed invention.

I claim:

1. A portable play yard capable of folding to a compact unit convenient for transporting and storing comprising a frame assembly and a flexible fabric enclosure adapted to fit over the frame assembly, said frame assembly having a generally box-like outline when in an in-use mode with:

(a) four lower corner rail connecting members;

(b) four upper corner rail connecting members;

(c) a vertical corner rail permanently attached to each of the lower corner rail connecting members and each of the upper corner rail connecting members;

(d) a pair of pivotally connected floor support rails extending between adjacent sets of lower corner rail connecting members, wherein one end of each of said floor support rails is pivotally attached to one of the adjacent lower corner rail connecting members and both other ends of said floor support rails are pivotally connected together in a manner which permits said floor support rails to pivot only upwardly to become substantially parallel with the vertical corner rails;

(e) a pair of pivotally connected upper side rails extending between adjacent sets of upper corner rail connecting members, wherein one end of each of said upper side rails is pivotally attached to one of the adjacent upper corner rail connecting members and both other ends of said upper side rails are connected together by a frame lock capable of locking said pair of upper side rails in a straight line in-use configuration and capable of rotating about its axis to release said pair of upper side rails to cause them to pivot downwardly to become substantially parallel with the vertical corner rails in a non-use configuration wherein said frame lock has a pair of meshing hinge gears operably associated therewith and having an end of each upper side rail rotatably attached to one of said hinge gears such that the meshing hinge gears revolve around the upper side rails upon said frame lock being rotated about its axis and such that the meshing hinge gears rotate about one another to act as a single pivot point for the two rotatably attached upper side rails.

2. The portable play yard of claim 1 wherein the frame lock used to pivotally connect the upper side rails comprises (i) a housing having two side walls, two end walls, a top wall and a bottom wall, wherein the side walls have an inside face recessed to nest therein two hinge gears, each end wall has an arcuate slot to receive a side rail and permit movement of the side rail in an approximate 90 degree arc, the top wall has a projection to restrict movement of the side rail and the bottom wall has a projection to restrict movement of the side rails, (ii) a set of meshing hinge gears nested in the recessed inside faces of the housing halves, each hinge gear having a set of teeth extending about 90 degrees around its circumference and each hinge gear having a bore hole to receive an end of the side rail and (iii) a latch means to rotatably hold each side rail in each hinge gear.

3. The portable play yard of claim 2 wherein each hinge gear in the frame lock has the bore hole to receive the side rail offset from a center line and the gear teeth placed on the gear such that the bore hole is about opposite a start of the 90 degree arcuate arrangement of gear teeth to ensure that the gear teeth of the hinge gears are always in mesh.

4. The portable play yard of claim 3 wherein the latch means to rotatably hold each upper side rail in each hinge gear comprises a spring button mounted near the terminus of the side wall and a keyed opening in the hinge gear, said keyed opening being in communication with the bore hole and shaped to receive the spring button.

5. The portable play yard of claim 3 wherein the latch means to rotatably hold each side rail in each hinge gear comprises a spring button mounted near the terminus of the side wall and a keyed opening in the hinge gear, said keyed opening being in communication with the bore hole and shaped to receive the spring button.

6. The portable play yard of claim 1 wherein the floor support rails and the upper side rails are all approximate equal lengths.

7. The portable play yard of claim 6 wherein each of the lower corner support rails has a Y-shaped body with a foot and two legs, said foot having a cavity to receive the vertical corner rail in a fixed position and said legs having open top channels to receive the floor support rails and permit them to pivot.

8. The portable play yard of claim 1 wherein the floor support rails and the upper side rails are all approximate equal lengths.

9. A portable play yard capable of folding to a compact unit convenient for transporting and storing comprising a frame assembly and a flexible fabric enclosure adapted to fit over the frame assembly, said frame assembly having a generally box-like outline when in an in-use mode with:

(a) four lower corner rail connecting members;

(b) four upper corner rail connecting members;

(c) a vertical corner rail permanently attached to each of the lower corner rail connecting members and each of the upper corner rail connecting members;

(d) a pair of pivotally connected floor support rails extending between adjacent sets of lower corner rail connecting members, wherein one end of each of said floor support rails is pivotally attached to one of the adjacent lower corner rail connecting members and both other ends of said floor support rails are pivotally connected together in a manner which permits said floor support rails to pivot only upwardly to become substantially parallel with the vertical corner rails;

(e) a pair of pivotally connected upper side rails extending between adjacent sets of upper corner rail connecting members, wherein one end of each of said upper side rails is pivotally attached to one of the adjacent upper corner rail connecting members and both other ends of said upper side rails are connected together by a frame lock having (i) a housing with two side walls, two end walls, a top wall and a bottom wall, wherein the side walls have an inside face recessed to nest therein two meshing hinge gears, each end wall has an arcuate slot to receive an upper side rail and permit movement of the upper side rail in an approximate 90 degree arc, the top wall has a projection to restrict movement of the upper side rail and the bottom wall has a projection to restrict movement of the upper side rails, (ii) a set of meshing hinge gears nested in the recessed inside faces of the housing halves and operably associated to act as a single pivot point for the upper support rails, each said hinge gear having a set of teeth extending about 90 degrees around its circumference and each hinge gear having a bore hole to receive an end of the side rail and (iii) a latch means to rotatably hold each upper side rail in each hinge gear and where said frame lock is capable of locking said pair of upper side rails in a straight line in-use configuration and capable of rotating about its axis to release said pair of upper side rails to cause them to pivot downwardly to become substantially parallel with the vertical corner rails in a non-use configuration.

10. The portable play yard of claim 9 wherein each hinge gear in the frame lock has the bore hole to receive the upper side rail offset from a center line and the gear teeth placed on the gear such that the bore hole is about opposite a start of the 90 degree arcuate arrangement of gear teeth to ensure that the gear teeth of the hinge gears are always in mesh.

* * * * *